US008885839B2

(12) United States Patent
Kim

(10) Patent No.: US 8,885,839 B2
(45) Date of Patent: Nov. 11, 2014

(54) SIGNAL PROCESSING METHOD AND APPARATUS

(75) Inventor: Sun-min Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 448 days.

(21) Appl. No.: 12/914,040

(22) Filed: Oct. 28, 2010

(65) Prior Publication Data

US 2011/0150227 A1 Jun. 23, 2011

(30) Foreign Application Priority Data

Dec. 23, 2009 (KR) ..... 10-2009-0130037

(51) Int. Cl.
*H04R 5/00* (2006.01)
*G10L 21/0272* (2013.01)
*G10L 19/008* (2013.01)

(52) U.S. Cl.
CPC ..... *G10L 21/0272* (2013.01); *H04S 2400/05* (2013.01); *G10L 19/008* (2013.01)
USPC ..... 381/27

(58) Field of Classification Search
CPC ..... G10L 19/008; H04S 2400/05
USPC ..... 381/27
See application file for complete search history.

(56) References Cited

U.S. PATENT DOCUMENTS

2006/0053003 A1* 3/2006 Suzuki et al. ..... 704/216
2010/0183155 A1 7/2010 Kim

FOREIGN PATENT DOCUMENTS

EP 0 505 645 B1 4/1999
KR 10-2010-0084319 A 7/2010

* cited by examiner

*Primary Examiner* — Alexander Jamal
(74) *Attorney, Agent, or Firm* — Sughrue Mion, PLLC

(57) ABSTRACT

Provided is a signal processing method which calculates a correlation coefficient indicating the degree of relation in a stereo signal and extracts a speech signal from the stereo signal by using the correlation coefficient and the stereo signal.

27 Claims, 5 Drawing Sheets

SIGNAL PROCESSING METHOD AND APPARATUS

CROSS-REFERENCE TO RELATED PATENT APPLICATION

This application claims the benefit of Korean Patent Application No. 10-2009-0130037, filed on Dec. 23, 2009, in the Korean Intellectual Property Office, the disclosure of which is incorporated herein in its entirety by reference.

BACKGROUND

1. Field

The exemplary embodiments relate to a signal processing method and apparatus, and more particularly, to a signal processing method and apparatus which effectively separates a speech signal from a stereo signal by using a correlation coefficient indicating the degree of relation in the stereo signal.

2. Description of the Related Art

As a thickness of a device, such as a radio or a television, for outputting an audio signal including a speech signal decreases, sound quality deterioration of the speech signal further worsens. When the speech signal is mixed with noise or a performance signal, the speech signal is difficult to hear.

To make the speech signal clearly audible by amplifying the speech signal, a formant component of the speech signal may be analyzed and amplified. However, when a performance signal such as musical instrument sound is mixed with the speech signal at the same time band, the performance signal in the time band is also amplified, thereby deteriorating the tone or quality of sound.

SUMMARY

The exemplary embodiments provide a method and apparatus for effectively separating a speech signal from a stereo signal by using a correlation coefficient indicating the degree of relation in the stereo signal and amplifying the speech signal.

According to an aspect of an exemplary embodiment, there is provided a signal processing method including calculating a correlation coefficient indicating a degree of relation in a stereo signal including a left stereo signal and a right stereo signal, and extracting a speech signal from the stereo signal by using the correlation coefficient and the stereo signal.

In an exemplary embodiment, the extracting of the speech signal may include arithmetically averaging the stereo signal and extracting the speech signal from the stereo signal by using a product of the arithmetically averaged stereo signal and the correlation coefficient. The calculating of the correlation coefficient may include calculating a first coefficient indicating a coherence between the left stereo signal and the right stereo signal and calculating a second coefficient indicating a similarity between the left stereo signal and the right stereo signal.

The calculating of the first coefficient may include calculating the first coefficient, taking account of a past coherence between the left stereo signal and the right stereo signal by using a probability and statistics function. The calculating of the second coefficient may include calculating the second coefficient, taking account of a similarity between the left stereo signal and the right stereo signal at a current point in time.

The calculating of the correlation coefficient may include calculating the correlation coefficient by using a product of the first coefficient and the second coefficient. The correlation coefficient may be a real number which is greater than or equal to 0 and less than or equal to 1. The signal processing method may further include transforming a domain of the stereo signal into a time-frequency domain prior to the calculating of the correlation coefficient.

The signal processing method may further include transforming a domain of the extracted speech signal into a time domain, and generating an ambient stereo signal by subtracting the speech signal from the stereo signal. The signal processing method may further include amplifying the speech signal. The signal processing method may further include generating a new stereo signal by using the ambient stereo signal and the amplified speech signal, and outputting the new stereo signal.

According to another aspect of an exemplary embodiment, there is provided a signal processing apparatus including a correlation coefficient calculation unit calculating a correlation coefficient indicating a degree of relation in a stereo signal including a left stereo signal and a right stereo signal, and a speech signal extraction unit extracting a speech signal from the stereo signal by using the correlation coefficient and the stereo signal.

According to another aspect of an exemplary embodiment, there is provided a computer-readable recording medium having recorded thereon a program for executing a signal processing method including calculating a correlation coefficient indicating a degree of relation in a stereo signal including a left stereo signal and a right stereo signal, and extracting a speech signal from the stereo signal by using the correlation coefficient and the stereo signal.

According to yet another aspect of an exemplary embodiment, there is provided a signal processing method including: separating an input stereo signal into a left stereo signal and a right stereo signal; determining coherence between the left stereo signal and the right stereo signal based on a past and a current frame; determining similarity between the left stereo signal and the right stereo signal based on the current frame and not on the past frame; determining a product of the determined coherence and the determined similarity as a correlation; and extracting a vocal component from the input stereo signal based on the correlation to output the vocal component and an ambient stereo signal.

BRIEF DESCRIPTION OF THE DRAWINGS

The above and other features of the exemplary embodiments will become more apparent by describing in detail with reference to the attached drawings in which.

DETAILED DESCRIPTION

Hereinafter, exemplary embodiments will be described with reference to the accompanying drawings.

Figure 1:
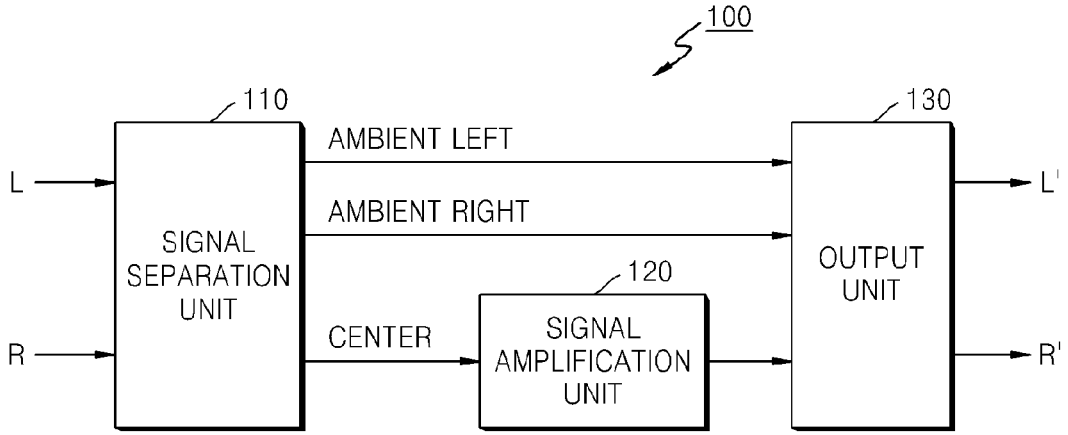
FIG. 1 is a block diagram of a signal processing apparatus according to an exemplary embodiment.

FIG. 1 is a block diagram of a signal processing apparatus 100 according to an exemplary embodiment. The signal processing apparatus 100 shown in FIG. 1 includes a signal separation unit 110, a signal amplification unit 120, and an output unit 130.

The signal separation unit 110 receives a stereo signal including a left stereo signal L and a right stereo signal R and separates a speech or vocal signal from the stereo signal. Hereinafter speech signals and vocal signals are used interchangeably. Each of the left stereo signal L and the right stereo signal R may include a speech signal and a performance signal resulting from the play of musical instruments.

When each of a plurality of sound sources generates a sound signal in an orchestra or concert, the sound signals are picked up by two microphones positioned at the left and right sides of a stage to form left and right stereo signals, that is, a stereo signal.

A sound output from an identical sound source may result in a picked-up sound signal that differs according to a position of a microphone. Since a sound source which generates a speech signal, such as a singer or an announcer, is usually positioned at the center of the stage, a stereo signal generated for the speech signal generated from the sound source positioned at the center of the stage has a left stereo signal and a right stereo signal which are identical to each other. However, when a sound source is not positioned at the center of the stage, a sound, even if being output from an identical sound source, may result in different sound signals that are picked up by the two microphones because of differences in the intensity of the sound arriving at the two microphones and the time of the arrival, thus resulting in a left stereo signal and a right stereo signal which are different from each other.

In an exemplary embodiment, the speech signal is separated from the stereo signal wherein a speech signal is included identically in the left stereo signal and the right stereo signal and a performance signal other than the speech signal is included differently in the left stereo signal and the right stereo signal. To this end, the signal separation unit 110 calculates a correlation coefficient between the left stereo signal and the right stereo signal. The correlation coefficient indicates the degree of relation between the left stereo signal and the right stereo signal. The signal separation unit 110 calculates a correlation coefficient in such a way that the correlation coefficient is 1 for a signal, such as the speech signal, included identically in the left stereo signal and the right stereo signal, and the correlation coefficient is 0 for a signal, such as the performance signal, included differently in the left stereo signal and the right stereo signal.

The signal separation unit 110 extracts the speech signal from the stereo signal by using the correlation coefficient and the stereo signal.

Herein, a signal included identically in a left stereo signal and a right stereo signal of a stereo signal, e.g., a speech signal, will be referred to as a center signal, and a signal remaining after subtracting the center signal from the stereo signal will be referred to as an ambient stereo signal including a left ambient signal and a right ambient signal.

The signal separation unit 110 generates the ambient stereo signal by subtracting the center signal (or the speech signal) from the stereo signal. The signal separation unit 110 outputs the ambient stereo signal to the output unit 130 and the center signal to the signal amplification unit 120.

The signal amplification unit 120 receives the center signal from the signal separation unit 110 and amplifies the center signal. The signal amplification unit 120 amplifies the center signal by using a band pass filter (BPF) having a center frequency. The signal amplification unit 120 outputs the amplified center signal to the output unit 130.

The output unit 130 generates a new stereo signal including a new left stereo signal L' and a new right stereo signal R' by using the ambient stereo signal received from the signal separation unit 110 and the amplified center signal received from the signal amplification unit 120. The output unit 130 may adjust signal values by multiplying the left and right ambient signals and the amplified center signal by different gains respectively. The output unit 130 generates the new left stereo signal L' and the new right stereo signal R' by adding the center signal to the left ambient signal and the right ambient signal.

As such, according to an exemplary embodiment, the correlation coefficient is obtained by using the stereo signal and the center signal is extracted from the stereo signal by using the correlation coefficient.

In addition, according to an exemplary embodiment, by separating the center signal from the stereo signal and amplifying the center signal and then adding the amplified center signal to the ambient stereo signal, the center signal can be heard more clearly than the ambient stereo signal.

Figure 2:
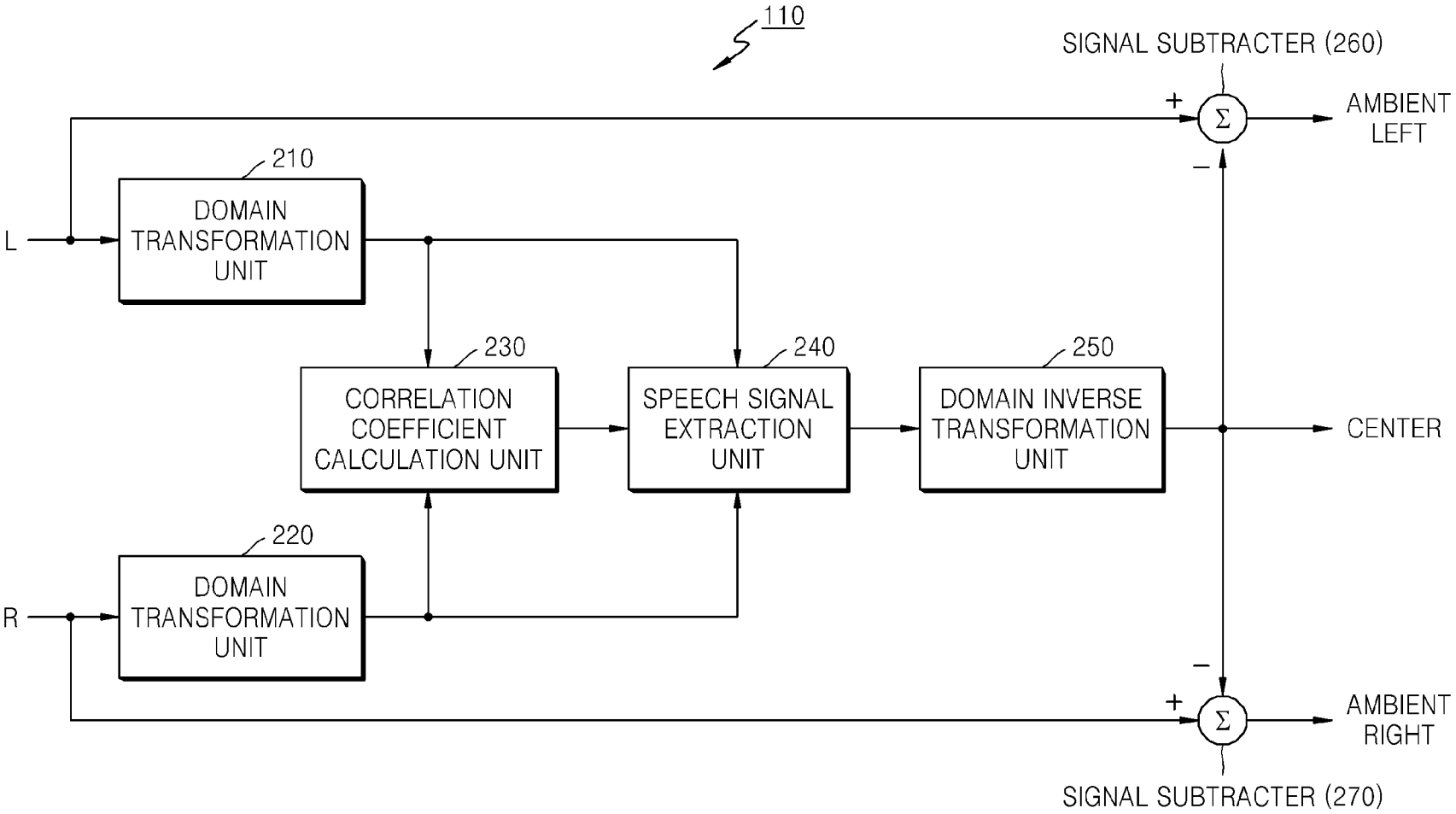
FIG. 2 is a block diagram of a signal separation unit shown in FIG. 1, according to an exemplary embodiment.

FIG. 2 is a block diagram of the signal separation unit 110 shown in FIG. 1, according to an exemplary embodiment. Referring to FIG. 2, the signal separation unit 110 includes domain transformation units 210 and 220, a correlation coefficient calculation unit 230, a speech signal extraction unit 240, a domain inverse transformation unit 250, and signal subtracters 260 and 270.

The domain transformation units 210 and 220 receive a stereo signal including a left stereo signal L and a right stereo signal R. The domain transformation units 210 and 220 transform a domain of the stereo signal. The domain transformation units 210 and 220 transform a domain of the stereo signal into a time-frequency domain by using an algorithm such as a fast Fourier transform (FFT). The time-frequency domain is used to express changes in time and frequency at the same time, in which a signal is divided into a plurality of frames according to time and frequency and a signal in each frame is expressed as frequency sub-bands in each time slot.

The correlation coefficient calculation unit 230 calculates a correlation coefficient by using the stereo signal which is domain-transformed to the time-frequency domain by the domain transformation units 210 and 220. The correlation coefficient calculation unit 230 calculates a first coefficient indicating a coherence between the left stereo signal and the right stereo signal and a second coefficient indicating a similarity between the left stereo signal and the right stereo signal, and calculates a correlation coefficient by using the first coefficient and the second coefficient.

The coherence between the left stereo signal and the right stereo signal means the degree of relation between the left stereo signal and the right stereo signal. In the time-frequency domain, the first coefficient may be expressed as follows:

$$\phi(n, k) = \frac{|\phi_{12}(n, k)|}{\sqrt{\phi_{11}(n, k)\phi_{12}(n, k)}}, \tag{1}$$

where n represents a time, that is, a time slot, and k represents a frequency band. In Equation 1, a denominator is a factor for normalizing the first coefficient. The first coefficient is a real number that is greater than or equal to 0 and is less than or equal to 1.

In Equation 1, $\phi_{ij}(n,k)$ may be expressed by using an expectation function, as follows:

$$\phi_{ij}=E[X_i^*X^*_j] \quad (2),$$

where $X_i$ and $X_j$ represent stereo signals expressed as complex numbers in the time-frequency domain, and $X^*_j$ represents a complex conjugate number of $X_j$. The expectation function is a probability and statistics function used to calculate an average of current stereo signals, taking account of past signals. When a product of $X_i$ and $X^*_j$ is applied to the expectation function, a current coherence between two current stereo signals $X_i$ and $X_j$ is represented in view of a statistic of a past coherence between the two stereo signals $X_i$ and $X_j$. Since Equation 2 is computationally intensive, an approximate value thereof may be expressed as follows:

$$\phi_{ij}(n,k)=(1-\lambda)\phi_{ij}(n-1,k)+\lambda X_i(n,k)X^*_j(n,k) \quad (3),$$

where a first term, (n−1, k), represents a coherence between left and right stereo signals in a frame immediately before a current frame, that is, a frame having an $(n-1)^{th}$ time slot and a $k^{th}$ frequency band. In other words, Equation 3 means that a coherence between signals in a past frame preceding a current frame is considered when a coherence between signals in the current frame is considered, and is expressed to predict a coherence between current left and right stereo signals as a probability by using a statistic, that is, a past coherence between the left and right stereo signals obtained using a probability and statistics function.

In Equation 3, constants (1−λ) and λ are multiplied to corresponding terms and are used to apply specific weights to a past average value and a current value. As the constant (1−λ) increases, it means that the current signal is much affected by the past.

The correlation coefficient calculation unit 230 obtains Equation 1 by using Equation 2 or Equation 3. The correlation coefficient calculation unit 230 calculates the first coefficient indicative of a coherence between stereo signals.

The correlation coefficient calculation unit 230 calculates the second coefficient indicative of a similarity between stereo signals. In the time-frequency domain, the second coefficient may be expressed as follows:

$$\psi(n,k)=\frac{2|\psi_{12}(n,k)|}{\psi_{11}(n,k)+\psi_{22}(n,k)}, \quad (4)$$

where n represents a time, that is, a time slot, and k represents a frequency band. In Equation 4, a denominator is a factor for normalizing the second coefficient. The second coefficient is a real number that is greater than or equal to 0 and is less than or equal to 1.

In Equation 4, $\psi_{ij}(n,k)$ is expressed as follows:

$$\psi_{ij}(n,k)=X_i(n,k)X^*_j(n,k) \quad (5),$$

where $X_i$ and $X_j$ represent signals expressed as complex numbers in the time-frequency domain, and $X^*_j$ represents a complex conjugate number of $X_j$.

Unlike in Equation 2 or Equation 3 where the first coefficient is calculated taking account of past signals by using a probability and statistics function, past signals are not considered when $\psi_{ij}(n,k)$ is calculated in Equation 5. That is, the correlation coefficient calculation unit 230 considers a similarity between two stereo signals only in a current frame.

The correlation coefficient calculation unit 230 obtains Equation 4 by using Equation 5, and calculates the second coefficient by using Equation 4.

In the exemplary embodiment, the correlation coefficient calculation unit 230 calculates a correlation coefficient Δ by using the first coefficient and the second coefficient. The correlation coefficient Δ may be expressed as follows.

$$\Delta(n,k)=\phi(n,k)\psi(n,k) \quad (6)$$

As can be seen from Equation 6 in the exemplary embodiment, the correlation coefficient considers both a similarity and a coherence between two stereo signals. Since the first coefficient and the second coefficient are real numbers that are greater than or equal to 0 and less than or equal to 1, the correlation coefficient is also a real number that is greater than or equal to 0 and less than or equal to 1.

The correlation coefficient calculation unit 230 calculates the correlation coefficient and outputs the correlation coefficient to the speech signal extraction unit 240. The speech signal extraction unit 240 extracts the center signal from the stereo signal by using the correlation coefficient and the stereo signal. The speech signal extraction unit 240 calculates an arithmetic average of the stereo signal and multiplies the arithmetic average by the correlation coefficient, thereby generating the center signal. The center signal generated by the speech signal extraction unit 240 may be expressed as follows:

$$C(n,k)=\Delta(n,k)*\frac{(X_1(n,k)+X_2(n,k))}{2}, \quad (7)$$

where $X_1(n,k)$ and $X_2(n,k)$ represent a left signal and a right signal in a frame having a time n and a frequency k.

The speech signal extraction unit 240 outputs the center signal generated using Equation 7 to the domain inverse transformation unit 250. The domain inverse transformation unit 250 transforms the center signal generated in the time-frequency domain into a time domain by using an algorithm such as an inverse fast Fourier transform (IFFT). The domain inverse transformation unit 250 outputs the center signal, which is domain-transformed to the time domain, to the signal subtracters 260 and 270.

The signal subtracters 260 and 270 obtain a difference between the stereo signal and the center signal in the time domain. The signal subtraction units 260 and 270 obtain a left ambient signal by subtracting the center signal from a left stereo signal and a right ambient signal by subtracting the center signal from a right stereo signal.

According to an exemplary embodiment, the correlation coefficient calculation unit 230 calculates the first coefficient indicating a coherence between current left and right stereo signals, taking account of a coherence between the left and right stereo signals at a past point in time, and calculates the second coefficient indicating a similarity between the current left and right stereo signals at the current point in time. According to an exemplary embodiment, the correlation coefficient calculation unit 230 generates the correlation coefficient by using the first coefficient and the second coefficient and extracts the center signal from the stereo signal by using the correlation coefficient. In addition, according to an exemplary embodiment, since the correlation coefficient is obtained in the time-frequency domain, rather than in the time domain, the correlation coefficient can be obtained more precisely by considering both time and frequency.

Figure 3:
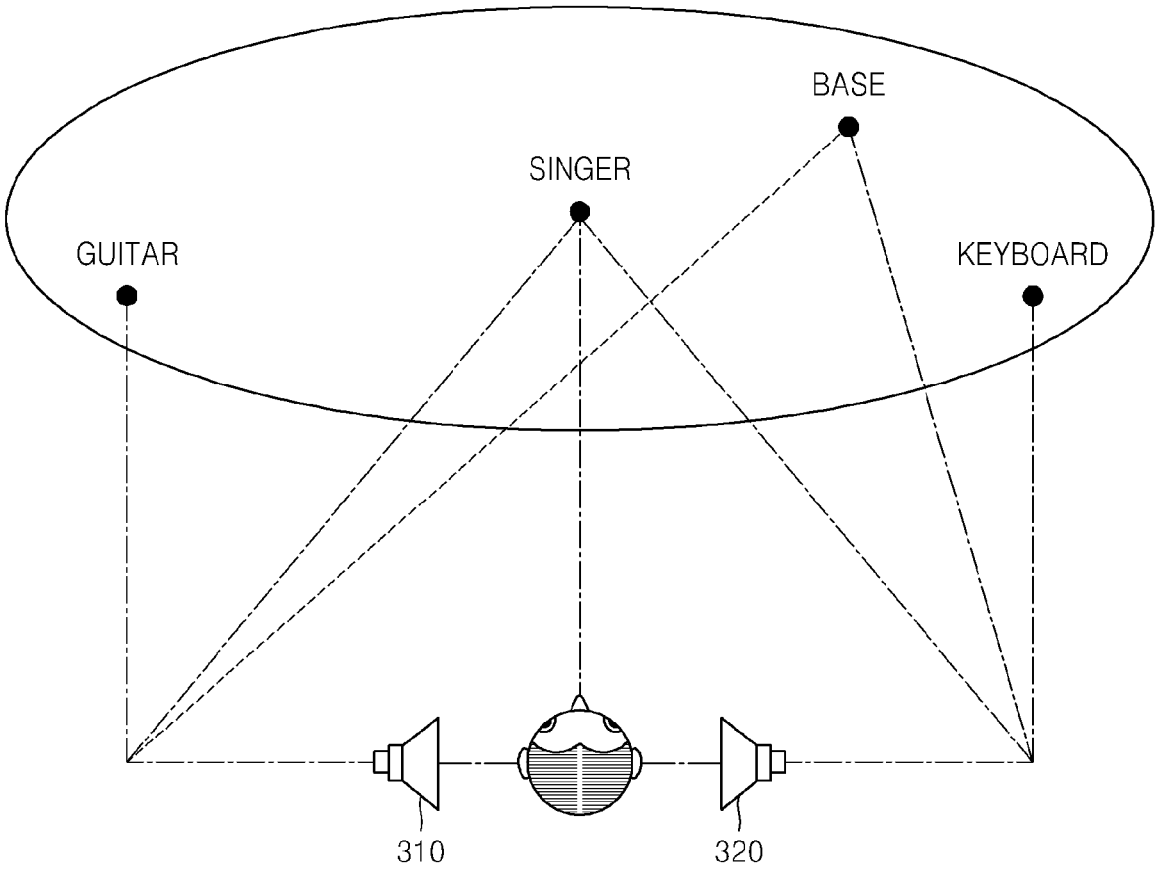
FIG. 3 is a view for explaining separating a speech signal from a plurality of sound sources by using a correlation coefficient according to an exemplary embodiment if the plurality of sound sources generate sound signals, respectively, according to an exemplary embodiment.

FIG. 3 is a view for explaining separating a center signal from a plurality of sound sources by using a correlation coefficient according to the exemplary embodiment if the plurality of sound sources generate sound signals, respectively.

Referring to FIG. 3, it can be seen that sound sources, such as a guitar, a singer, a base, and a keyboard, are positioned in particular positions on a stage. In FIG. 3, the singer generates a center signal in the center of the stage, the guitar generates a sound signal at the left side of the stage, and the keyboard generates a sound signal at the right side of the stage. The base generates a sound signal between the center and the right side of the stage.

Two microphones (not shown) pick up sound signals generated by the plurality of sound sources, thus generating a stereo signal including a left stereo signal and a right stereo signal. The stereo signal generated by the microphones is output as the left stereo signal and the right stereo signal from a left speaker 310 and a right speaker 320, respectively.

In FIG. 3, the sound signal generated by the guitar is included only in the left stereo signal and the sound signal generated by the keyboard is included only in the right stereo signal. The center signal of the singer positioned in the center of the stage is included identically in both the left stereo signal and the right stereo signal.

The correlation coefficient calculation unit 230 calculates a coherence between the left stereo signal and the right stereo signal being output respectively from the left speaker 310 and the right speaker 320. When the correlation coefficient calculation unit 230 calculates a coherence between the left stereo signal and the right stereo signal for each sound signal, the sound signal generated from the guitar is included only in the left stereo signal and thus the left stereo signal and the right stereo signal have no coherence therebetween. Therefore, the first coefficient for the sound signal generated from the guitar is 0. Since the sound signal generated from the keyboard is included only in the right stereo signal, the left stereo signal and the right stereo signal have no coherence therebetween. Consequently, the first coefficient for the sound signal generated from the keyboard is 0. For the center signal, which is included identically both in the left stereo signal and the right stereo signal, the first coefficient is 1.

The sound signal generated from the base is included in both the left stereo signal and the right stereo signal, but in different degrees. In this case, when the first coefficient is calculated for the sound signal generated from the base by using Equation 1, the first coefficient may not be 0. That is, the first coefficient calculated using Equation 1 is 0 only when a performance signal is included in one of the left stereo signal and the right stereo signal, in other cases, the first coefficient is a real number that is greater than 0 and less than or equal to 1.

Accordingly, assuming that the correlation coefficient calculation unit 230 generates the center signal by using only the first coefficient, that is, the correlation coefficient calculation unit 230 determines a product of an average of the left stereo signal and the right stereo signal and the first coefficient as the center signal in Equation 6 and Equation 7, a sound signal generated from a sound source positioned in the same position as the base may be mistakenly recognized as the center signal.

The correlation coefficient calculation unit 230 calculates a similarity between the left stereo signal and the right stereo signal being output from the left speaker 310 and the right speaker 320. When the correlation coefficient calculation unit 230 calculates a similarity between the left stereo signal and the right stereo signal for each sound signal, the sound signal generated from the guitar is included only in the left stereo signal and thus the left stereo signal and the right stereo signal have no similarity therebetween. Therefore, the second coefficient for the sound signal generated from the guitar is 0. Since the sound signal generated from the keyboard is included only in the right stereo signal, the left stereo signal and the right stereo signal have no similarity therebetween. Consequently, the second coefficient for the sound signal generated from the keyboard is 0.

However, when the sound signal generated from the guitar and the sound signal generated from the keyboard can be simultaneously heard from the left speaker 310 and the right speaker 320, that is, when the sound signal generated from the guitar is included in the left stereo signal and the sound signal generated from the keyboard is included in the right stereo signal, the second coefficient indicating a similarity between the left stereo signal and the right stereo signal is calculated as a non-zero value by using Equation 4. In other words, when the sound signal generated from the guitar and the sound signal generated from the keyboard, although being independent of each other, are included in the left stereo signal and the right stereo signal, respectively, and are heard at the same time, the second coefficient indicating a similarity between the left stereo signal and the right stereo signal is a non-zero real number that is less than 1.

Assuming that the correlation coefficient calculation unit 230 extracts the center signal by using only the second coefficient in Equation 6 and Equation 7, when signals are generated by the guitar and the keyboard at the same time, they may be mistakenly recognized as the center signal.

In an exemplary embodiment, the correlation coefficient is calculated by multiplying the first coefficient and the second coefficient, thereby preventing the foregoing problem. That is, for a signal generated from a sound source positioned in the same position as the base, the first coefficient is a non-zero real number, but the second coefficient is 0, whereby a product of the first coefficient and the second coefficient, that is, the correlation coefficient is 0. When signals are generated by the guitar and the keyboard at the same time, the second coefficient is a non-zero real number, but the first coefficient is 0, whereby a product of the first coefficient and the second coefficient, that is, the correlation coefficient is 0.

As such, in an exemplary embodiment, since the correlation coefficient is calculated by using a product of the first coefficient and the second coefficient, the correlation coefficient is 0 if only one of the first coefficient and the second coefficient is 0, thereby accurately separating the center signal from the stereo signal.

Figure 4:
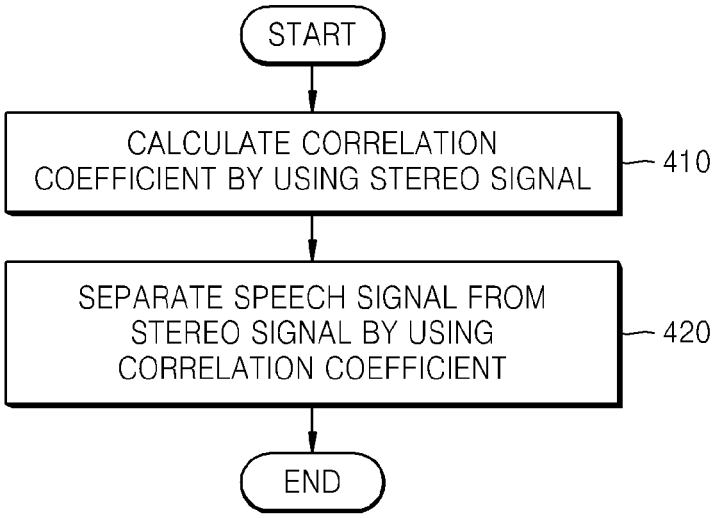
FIG. 4 is a flowchart illustrating a signal processing method according to an exemplary embodiment.

FIG. 4 is a flowchart illustrating a signal processing method according to an exemplary embodiment. Referring to FIG. 4, the signal processing apparatus 100 calculates a correlation coefficient by using a stereo signal including a left stereo signal and a right stereo signal in operation 410. The signal processing apparatus 100 calculates a first coefficient indicating a coherence between the left stereo signal and the right stereo signal and calculates a second coefficient indicating a similarity between the left stereo signal and the right stereo signal. The correlation coefficient is calculated considering both the similarity and the coherence in the stereo signal. The signal processing apparatus 100 separates a center signal (or a speech signal) from the stereo signal by using the correlation coefficient in operation 420.

Figure 5:
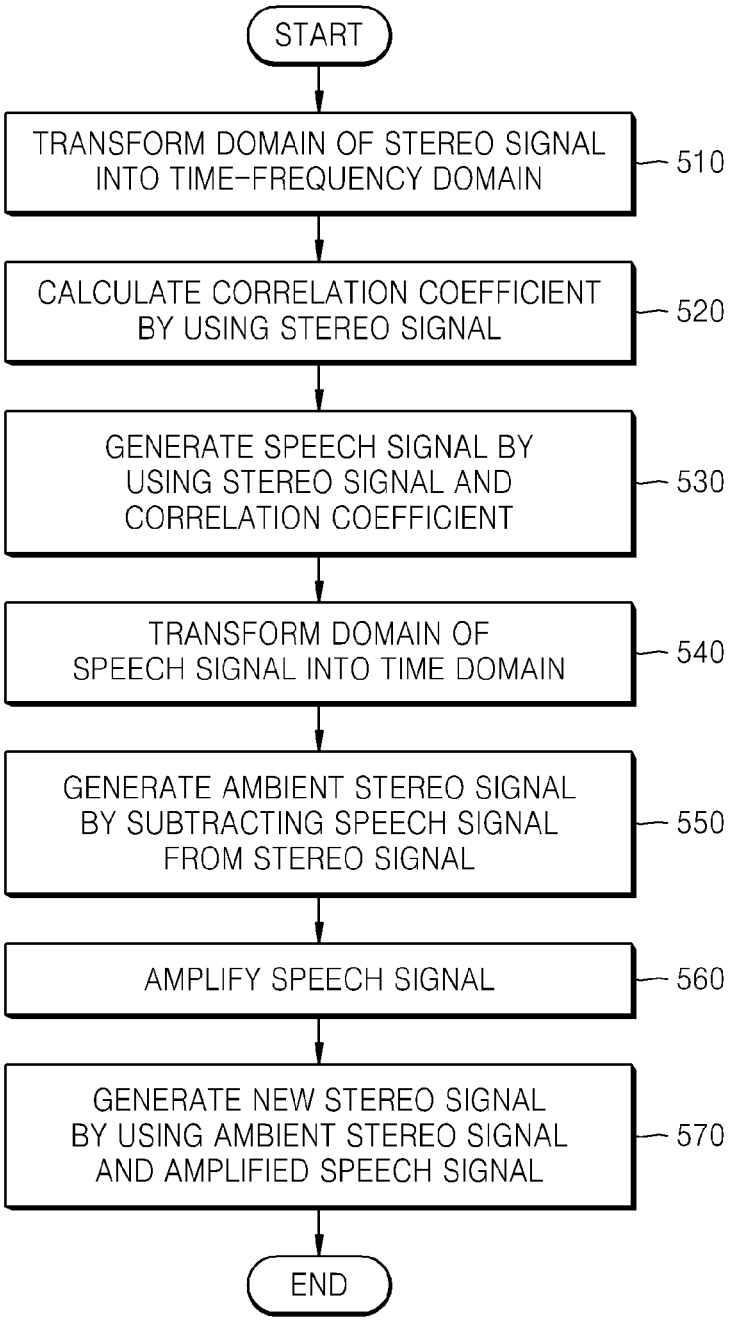
FIG. 5 is a flowchart illustrating a signal processing method according to another exemplary embodiment.

FIG. 5 is a flowchart illustrating a signal processing method according to another exemplary embodiment. Referring to FIG. 5, the signal processing apparatus 100 transforms the stereo signal from time domain into a time-frequency domain in operation 510. The signal processing apparatus 100 calculates a correlation coefficient by using the stereo signal in the time-frequency domain in operation 520. The signal processing apparatus 100 calculates the first coefficient indicating a current coherence between a left stereo signal and a right stereo signal, taking account of a past coherence between the left stereo signal and the right stereo signal by using a probability and statistics function.

The signal processing apparatus 100 calculates the second coefficient indicating a similarity between the left stereo signal and the right stereo signal in a current frame. The signal processing apparatus 100 calculates the correlation coefficient by multiplying the first coefficient and the second coefficient. Since both the first coefficient and the second coefficient are real numbers that are greater than or equal to 0 and less than or equal to 1, the correlation coefficient is also greater than or equal to 0 and less than or equal to 1.

The signal processing apparatus 100 generates the center signal (or the speech signal) by using the correlation coefficient and the stereo signal in operation 530. The signal processing apparatus 100 calculates an arithmetic average of the left stereo signal and the right stereo signal and multiplies the average by the correlation coefficient, thereby generating the center signal.

The signal processing apparatus 100 inversely transforms the domain of the center signal from the time-frequency domain into the time domain in operation 540. The signal processing apparatus 100 generates an ambient stereo signal in the time domain in operation 550. That is, the signal processing apparatus 100 generates a left ambient signal and a right ambient signal by subtracting the center signal from the left stereo signal and the right stereo signal in operation 550.

The signal processing apparatus 100 amplifies a speech signal by filtering the center signal with a band pass filter (BPF) in operation 560. The signal processing apparatus 100 generates a new stereo signal by adding the amplified center signal to the ambient signal and outputs the generated new stereo signal in operation 570. The signal processing apparatus 100 may adjust the intensities of the ambient stereo signal and the amplified center signal by multiplying the ambient stereo signal and the amplified center signal by different gains before generating the new stereo signal. In this case, the signal processing apparatus 100 may generate the new stereo signal by summing up the gain-multiplied signals.

As is apparent from the foregoing description, the speech signal can be clearly heard by being effectively separated from the stereo signal and amplified.

The signal processing method and apparatus according to the present invention can be embodied as a computer-readable code on a computer-readable recording medium. The computer-readable recording medium is any data storage device that can store data which can be thereafter read by a computer system. Examples of computer-readable recording media include read-only memory (ROM), random-access memory (RAM), CD-ROMs, magnetic tapes, floppy disks, optical data storage devices, and carrier waves. The computer-readable recording medium can also be distributed over network of coupled computer systems so that the computer-readable code is stored and executed in a decentralized fashion. Also, functional programs, code, and code segments for implementing the signal processing method can be easily construed by programmers of skill in the art.

While the present invention has been particularly shown and described with reference to exemplary embodiments thereof, it will be understood by those of ordinary skill in the art that various changes in form and details may be made therein without departing from the spirit and scope of the present invention as defined by the following claims. Accordingly, the disclosed embodiments should be considered in an illustrative sense not in a limiting sense. The scope of the present invention is defined not by the detailed description of the present invention but by the appended claims, and all differences within the scope will be construed as being included in the present invention.

What is claimed is:

1. A signal processing method comprising:

calculating a correlation coefficient indicating a degree of relation between a left stereo signal and a right stereo signal of a stereo signal, the calculating comprising calculating a first coefficient indicating a first degree of relation between the left stereo signal and the right stereo signal based on a past first coefficient indicating the first degree of relation between the left stereo signal and the right stereo signal in a past frame; and extracting a speech signal from the stereo signal by using the correlation coefficient and the stereo signal.

2. The signal processing method of claim 1, wherein the extracting of the speech signal comprises:

averaging the stereo signal; and extracting the speech signal from the stereo signal by using a product of the averaged stereo signal and the correlation coefficient.

3. The signal processing method of claim 2, wherein the first degree of relation between the left stereo signal and the right stereo signal is a coherence between the left stereo signal and the right stereo signal, and the calculating of the correlation coefficient further comprises:

calculating a second coefficient indicating a similarity between the left stereo signal and the right stereo signal.

4. The signal processing method of claim 3, wherein the calculating of the first coefficient comprises calculating the first coefficient based on a past coherence between the left stereo signal and the right stereo signal, by using a probability and statistics function.

5. The signal processing method of claim 3, wherein the calculating of the second coefficient comprises calculating the second coefficient based on a similarity between the left stereo signal and the right stereo signal, at a current point in time.

6. The signal processing method of claim 3, wherein the calculating of the correlation coefficient comprises calculating the correlation coefficient by using a product of the first coefficient and the second coefficient.

7. The signal processing method of claim 3, wherein the correlation coefficient is a real number which is greater than or equal to 0 and less than or equal to 1.

8. The signal processing method of claim 1, further comprising transforming a domain of the stereo signal into a time-frequency domain prior to the calculating of the correlation coefficient.

9. The signal processing method of claim 8, further comprising:

transforming a domain of the extracted speech signal into a time domain; and generating an ambient stereo signal by subtracting the speech signal from the stereo signal.

10. The signal processing method of claim 9, further comprising amplifying the speech signal.

11. The signal processing method of claim 10, further comprising:

generating a new stereo signal by using the ambient stereo signal and the amplified speech signal; and outputting the new stereo signal.

12. A signal processing apparatus comprising:

a correlation coefficient calculation unit configured to calculate a correlation coefficient indicating a degree of relation between a left stereo signal and a right stereo signal of a stereo signal, wherein the correlation coefficient comprises a first coefficient indicating a first degree of relation between the left stereo signal and the right stereo signal, and the correlation coefficient calculation unit calculates the first coefficient based on a past first coefficient indicating the first degree of relation between the left stereo signal and the right stereo signal in a past frame; and a speech signal extraction unit configured to extract a speech signal from the stereo signal by using the correlation coefficient and the stereo signal.

13. The signal processing apparatus of claim 12, wherein the speech signal extraction unit averages the stereo signal and extracts the speech signal from the stereo signal by using a product of the averaged stereo signal and the correlation coefficient.

14. The signal processing apparatus of claim 13, wherein the first degree of relation between the left stereo signal and the right stereo signal is a coherence between the left stereo signal and the right stereo signal, and the correlation coefficient further comprises a second coefficient indicating a similarity between the left stereo signal and the right stereo signal.

15. The signal processing apparatus of claim 14, wherein the correlation coefficient calculation unit calculates the first coefficient based on a past coherence between the left stereo signal and the right stereo signal, by using a probability and statistics function.

16. The signal processing apparatus of claim 14, wherein the correlation coefficient calculation unit calculates the second coefficient based on a similarity between the left stereo signal and the right stereo signal, at a current point in time.

17. The signal processing apparatus of claim 14, wherein the correlation coefficient calculation unit calculates the correlation coefficient by using a product of the first coefficient and the second coefficient.

18. The signal processing apparatus of claim 14, wherein the correlation coefficient is a real number which is greater than or equal to 0 and less than or equal to 1.

19. The signal processing apparatus of claim 14, further comprising a domain transformation unit configured to transform a domain of the stereo signal into a time-frequency domain, wherein the correlation coefficient calculation unit calculates the correlation coefficient in the time-frequency domain, and the speech signal extraction unit extracts the speech signal in the time-frequency domain.

20. The signal processing apparatus of claim 19, further comprising:

a domain inverse transformation unit configured to transform a domain of the extracted speech signal into a time domain; and a signal extraction unit configured to generate an ambient stereo signal by subtracting the speech signal from the stereo signal.

21. The signal processing apparatus of claim 20, further comprising a signal amplification unit configured to amplify the speech signal.

22. The signal processing apparatus of claim 21, further comprising an output unit configured to generate a new stereo signal by using the ambient stereo signal and the amplified speech signal, and outputs the new stereo signal.

23. A computer-readable recording medium having recorded thereon a program for executing a signal processing method comprising:

calculating a correlation coefficient indicating a degree of relation between a left stereo signal and a right stereo signal of a stereo signal, the calculating comprising calculating a first coefficient indicating a first degree of relation between the left stereo signal and the right stereo signal based on a past first coefficient indicating the first degree of relation between the left stereo signal and the right stereo signal in a past frame; and extracting a speech signal from the stereo signal by using the correlation coefficient and the stereo signal.

24. A signal processing method comprising:

separating an input stereo signal into a left stereo signal and a right stereo signal;

determining coherence between the left stereo signal and the right stereo signal based on a past frame and a current frame;

determining similarity between the left stereo signal and the right stereo signal based on the current frame and not on the past frame;

determining a product of the determined coherence and the determined similarity as a correlation; and extracting a vocal component from the input stereo signal based on the correlation to output the vocal component and an ambient stereo signal.

25. The signal processing method of claim 24 further comprising amplifying the extracted vocal component and adding the amplified extracted vocal component to the ambient stereo signal.

26. The signal processing method of claim 24, wherein the coherence is zero if a sound source is substantially present in only one of the left and the right stereo signals.

27. The signal processing method of claim 24, wherein the coherence is one if a sound source is substantially identically present in the left and the right stereo signals.

* * * * *